US012221199B1

(12) United States Patent
Ito et al.

(10) Patent No.: US 12,221,199 B1
(45) Date of Patent: Feb. 11, 2025

(54) SYSTEM FOR AND METHOD OF CONTROLLING PROPULSION DEVICE

(71) Applicant: YAMAHA HATSUDOKI KABUSHIKI KAISHA, Iwata (JP)

(72) Inventors: Makoto Ito, Shizuoka (JP); Kohei Yamaguchi, Shizuoka (JP); Yoshikazu Nakayasu, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 1097 days.

(21) Appl. No.: 17/082,078

(22) Filed: Oct. 28, 2020

Related U.S. Application Data

(60) Provisional application No. 62/954,035, filed on Dec. 27, 2019.

(51) Int. Cl.
*B63H 25/02* (2006.01)
*B63H 20/12* (2006.01)

(52) U.S. Cl.
CPC ..... *B63H 25/02* (2013.01); *B63H 20/12* (2013.01); *B63H 2025/026* (2013.01)

(58) Field of Classification Search
None
See application file for complete search history.

(56) References Cited

U.S. PATENT DOCUMENTS

| | | | | |
|---|---|---|---|---|
| 9,231,034 | B1 * | 1/2016 | Chen | H10K 59/38 |
| 9,836,077 | B2 * | 12/2017 | Smith | G05G 1/015 |
| 10,150,501 | B1 * | 12/2018 | Brown | B62D 11/003 |
| 10,434,405 | B2 * | 10/2019 | Nelson | A63F 13/24 |
| 10,521,030 | B2 * | 12/2019 | Kaech | G06F 3/0338 |
| 10,860,968 | B1 * | 12/2020 | Iacono | G06Q 10/083 |
| 11,543,887 | B2 * | 1/2023 | Ang | G06F 3/0482 |
| 11,567,581 | B2 * | 1/2023 | Cipoletta | G06F 3/013 |
| 11,601,605 | B2 * | 3/2023 | Rees | H04N 23/23 |
| 11,625,101 | B2 * | 4/2023 | Kauffmann | G06F 3/017 345/156 |
| 2014/0282275 | A1 * | 9/2014 | Everitt | G06F 3/017 715/863 |
| 2019/0212832 | A1 * | 7/2019 | Kaech | G06F 3/0362 |

FOREIGN PATENT DOCUMENTS

| | | | | |
|---|---|---|---|---|
| JP | 2008-155764 | A | 7/2008 | |
| JP | 6829289 | B2 * | 2/2021 | G05G 1/015 |

* cited by examiner

*Primary Examiner* — Jean Paul Cass
(74) *Attorney, Agent, or Firm* — Keating & Bennett, LLP

(57) ABSTRACT

When a joystick is positioned within a first dead zone including a neutral position, a controller pauses a shifting action and steering of a propulsion device regardless of a tilt operation and a twist operation of the joystick. When the joystick is positioned within a second dead zone located rearward of the first dead zone, the controller pauses the shifting action of the propulsion device regardless of the tilt operation of the joystick and controls the steering of the propulsion device in accordance with the twist operation of the joystick.

16 Claims, 18 Drawing Sheets

SYSTEM FOR AND METHOD OF CONTROLLING PROPULSION DEVICE

CROSS REFERENCE TO RELATED APPLICATIONS

This application claims the benefit of priority to U.S. Provisional Patent Application No. 62/954,035 filed on Dec. 27, 2019. The entire contents of this application are hereby incorporated herein by reference.

BACKGROUND OF THE INVENTION

1. Field of the Invention

The present invention relates to a system for and a method of controlling a propulsion device.

2. Description of the Related Art

A type of system for controlling a propulsion device includes a joystick. For example, as described in Japan Laid-open Patent Application Publication No. 2008-155764, the joystick is operable in a back-and-forth direction by a tilt operation. The joystick is operable about the axis thereof by a twist operation. In the system, a controller receives a signal indicating the operation of the joystick. The controller controls a shifting action performed by a propulsion device to shift among forward, neutral, and reverse in accordance with the tilt operation of the joystick operated in the back-and-forth direction. The controller controls steering of the propulsion device in response to the twist operation of the joystick.

SUMMARY OF THE INVENTION

Preferred embodiments of the present invention provide a dead zone during operation of a joystick in order to prevent a propulsion device from suddenly performing a motion in response to operation of the joystick. When the joystick is positioned within the dead zone, the controller is disabled and prevented from controlling both the shifting action and the steering of the propulsion device. This prevents the propulsion device from being operated by the joystick.

Preferred embodiments of the present invention relate to a variety of characteristics of a system to control a propulsion device with use of a joystick.

A system according to a preferred embodiment of the present invention controls a propulsion device and includes a joystick and a controller. The joystick is operable from a neutral position in a back-and-forth direction by a tilt operation and is operable by a twist operation. The controller communicates with the joystick. The controller controls a shifting action among forward, neutral, and reverse of the propulsion device in accordance with the tilt operation of the joystick in the back-and-forth direction. The controller controls steering of the propulsion device in accordance with the twist operation of the joystick. The controller pauses the shifting action and the steering of the propulsion device regardless of the tilt operation and the twist operation of the joystick when the joystick is positioned within a first dead zone including the neutral position. The controller pauses the shifting action regardless of the tilt operation of the joystick and controls the steering of the propulsion device in accordance with the twist operation of the joystick when the joystick is positioned within a second dead zone located rearward of the first dead zone.

A method according to a preferred embodiment of the present invention includes controlling a propulsion device and the following processes. A first process includes receiving a signal from a joystick that is operable from a neutral position in a back-and-forth direction by a tilt operation and operable by a twist operation. A second process includes controlling a shifting action among forward, neutral, and reverse of the propulsion device in accordance with the tilt operation of the joystick operated in the back-and-forth direction. A third process includes controlling the steering of the propulsion device in accordance with the twist operation of the joystick. A fourth process includes pausing the shifting action and the steering of the propulsion device regardless of the tilt operation and the twist operation of the joystick when the joystick is positioned within a first dead zone including the neutral position. A fifth process includes pausing the shifting action regardless of the tilt operation of the joystick and controlling the steering of the propulsion device in accordance with the twist operation of the joystick when the joystick is positioned within a second dead zone located rearward of the first dead zone. It should be noted that the order of executing the respective processes is not limited to the above and may be changed.

A system according to another preferred embodiment of the present invention controls a propulsion device and includes a joystick and a controller. The joystick is operable from a neutral position in a back-and-forth direction by a tilt operation and operable by a twist operation. The controller communicates with the joystick. The controller controls a shifting action among forward, neutral, and reverse of the propulsion device in accordance with the tilt operation of the joystick operated in the back-and-forth direction. The controller controls the steering of the propulsion device in accordance with the twist operation of the joystick. The controller pauses the shifting action regardless of the tilt operation of the joystick and steers the propulsion device in a first direction in accordance with the twist operation of the joystick operated in a predetermined direction when the joystick is positioned within a first dead zone including the neutral position. The controller pauses the shifting action regardless of the tilt operation of the joystick and steers the propulsion device in a second direction opposite to the first direction in accordance with the twist operation of the joystick operated in the predetermined direction when the joystick is positioned within a second dead zone located rearward of the first dead zone.

A method according to another preferred embodiment of the present invention includes controlling a propulsion device and includes the following processes. A first process includes receiving a signal from a joystick that is operable from a neutral position in a back-and-forth direction by a tilt operation and operable by a twist operation. A second process includes controlling a shifting action among forward, neutral, and reverse of the propulsion device in accordance with the tilt operation of the joystick operated in the back-and-forth direction. A third process includes controlling steering of the propulsion device in accordance with the twist operation of the joystick. A fourth process includes pausing the shifting action regardless of the tilt operation of the joystick and the steering the propulsion device in a first direction in accordance with the twist operation of the joystick operated in a predetermined direction when the joystick is positioned within a first dead zone including the neutral position. A fifth process includes pausing the shifting action regardless of the tilt operation of the joystick and steering the propulsion device in a second direction opposite to the first direction in accordance with the twist operation of the joystick operated in the predetermined direction when the joystick is positioned within a second dead zone located rearward of the first dead zone.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
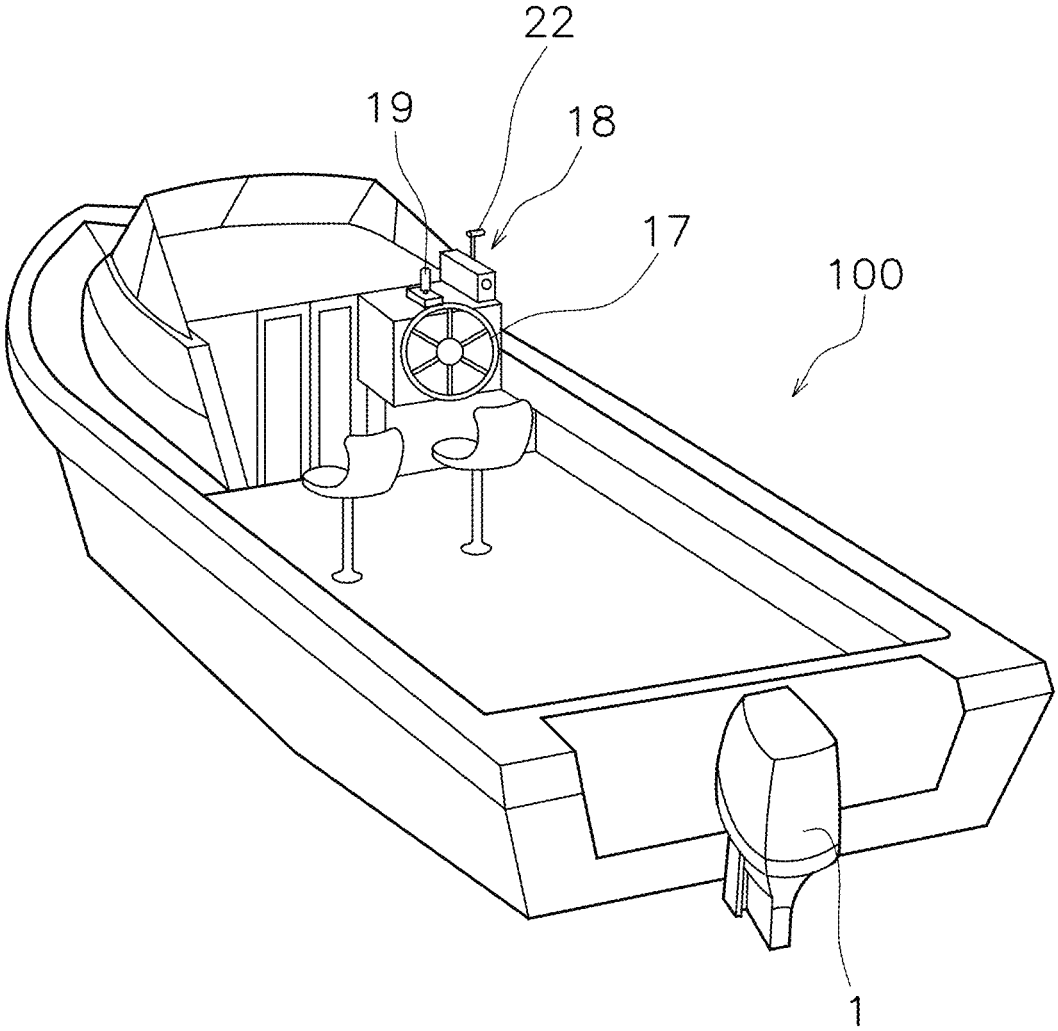
FIG. 1 is a perspective view of a watercraft in which a system according to a preferred embodiment of the present invention is installed.

Preferred embodiments of the present invention will be hereinafter explained with reference to the attached drawings. FIG. 1 is a perspective view of a watercraft 100 in which a system according to a preferred embodiment of the present invention is installed. The watercraft 100 includes a propulsion device 1. More specifically, the watercraft 100 includes the propulsion device 1 as a single propulsion device thereof. The propulsion device 1 is attached to the stern of the watercraft 100. The propulsion device 1 is, for instance, an outboard motor. The propulsion device 1 generates a thrust to propel the watercraft 100.

Figure 2:
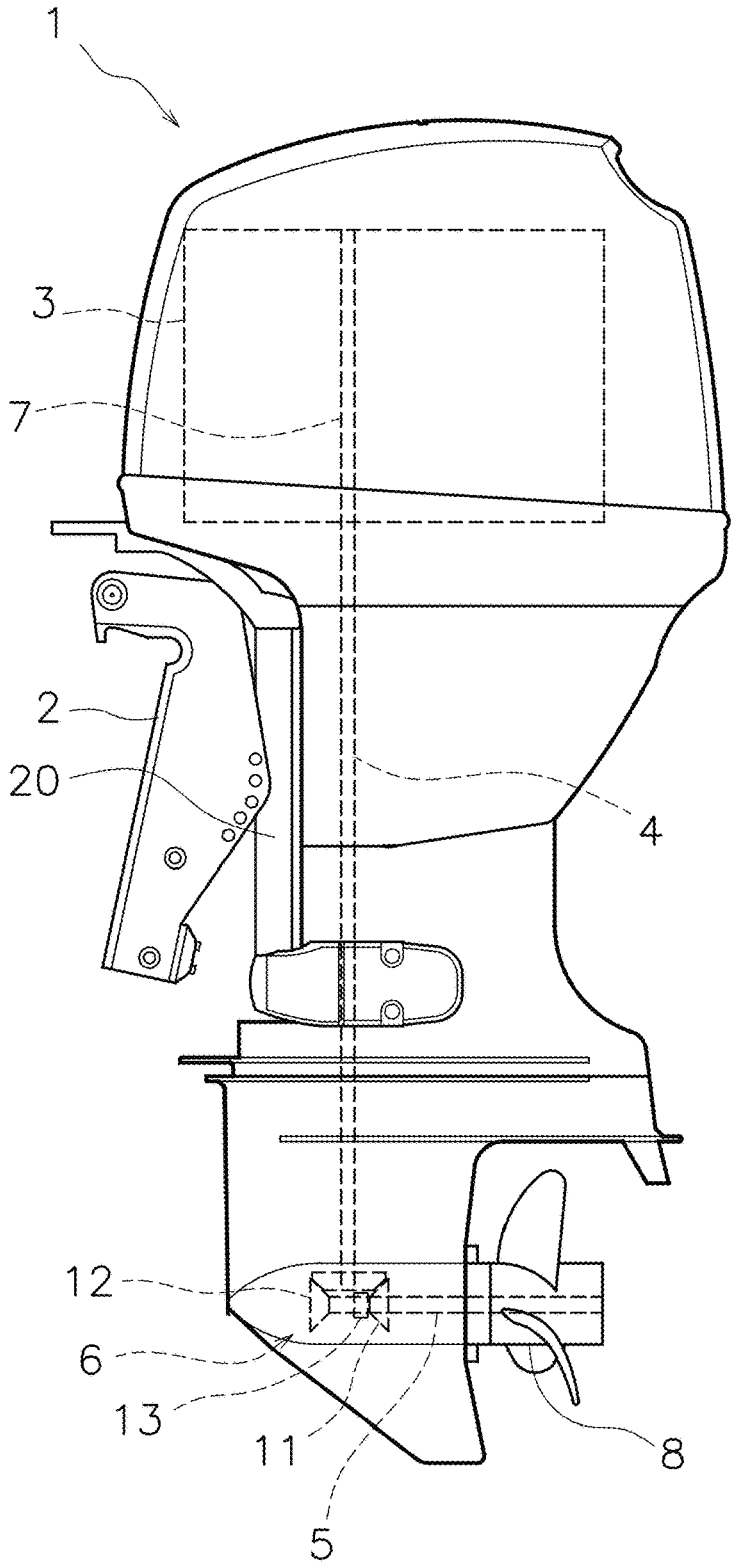
FIG. 2 is a side view of a propulsion device.

FIG. 2 is a side view of the propulsion device 1. The propulsion device 1 is attached to the watercraft 100 through a bracket 2. The bracket 2 supports the propulsion device 1 such that the propulsion device 1 is rotatable about a steering shaft 20. The steering shaft 20 extends in an up-and-down direction of the propulsion device 1.

The propulsion device 1 includes an engine 3, a driveshaft 4, a propeller shaft 5, and a shift mechanism 6. The engine 3 generates the thrust to propel the watercraft 100. The engine 3 includes a crankshaft 7. The crankshaft 7 extends in the up-and-down direction of the propulsion device 1. The driveshaft 4 is connected to the crankshaft 7. The drive shaft 4 extends in the up-and-down direction of the propulsion device 1. The propeller shaft 5 extends in a back-and-forth direction of the propulsion device 1. The propeller shaft 5 is connected to the driveshaft 4 through the shift mechanism 6. A propeller 8 is attached to the propeller shaft 5.

The shift mechanism 6 includes a forward gear 11, a reverse gear 12, and a dog clutch 13. The dog clutch 13 is movable to a forward position, a reverse position, and a neutral position. When the dog clutch 13 is in the forward position, forward rotation is transmitted from the drive shaft 4 to the propeller shaft 5 through the forward gear 11. When the dog clutch 13 is in the reverse position, reverse rotation is transmitted from the drive shaft 4 to the propeller shaft 5 through the reverse gear 12. When the dog clutch 13 is in the neutral position, rotation of the drive shaft 4 is not transmitted to the propeller shaft 5.

Figure 3:
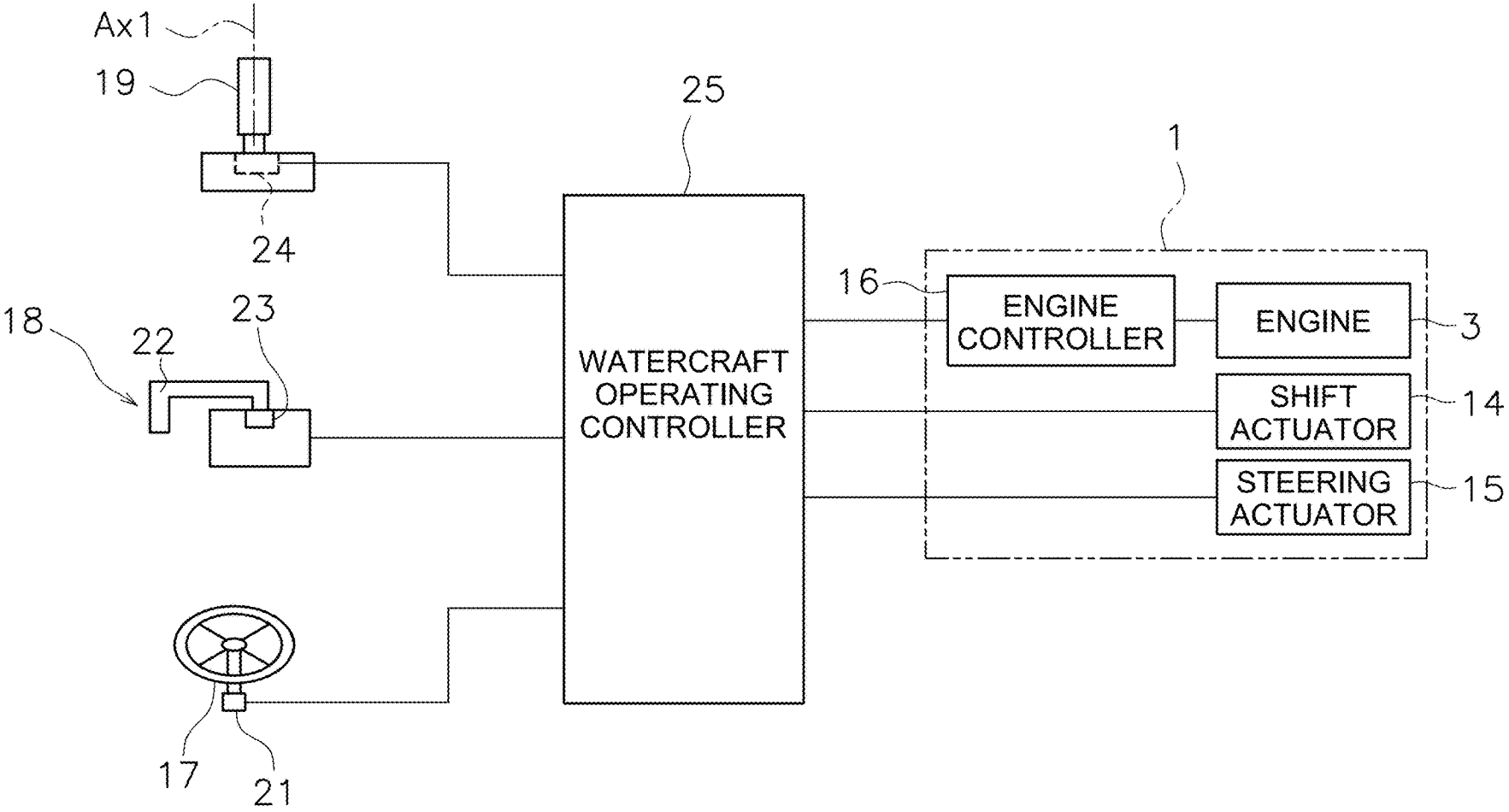
FIG. 3 is a block diagram showing a configuration of the system.

FIG. 3 is a schematic diagram showing a configuration of a system of the watercraft 100. As shown in FIG. 3, the propulsion device 1 includes a shift actuator 14 and a steering actuator 15. The shift actuator 14 is connected to the dog clutch 13 of the shift mechanism 6. The shift actuator 14 actuates the dog clutch 13 so as to switch engagement of the gears. Movement of the watercraft 100 is thus switched between forward movement and rearward movement. The shift actuator 14 is, for instance, an electric motor. However, the shift actuator 14 may be another type of actuator such as an electric cylinder, a hydraulic motor, or a hydraulic cylinder.

The steering actuator 15 is connected to the propulsion device 1. The steering actuator 15 rotates the propulsion device 1 about the steering shaft 20. Accordingly, the rudder angle of the propulsion device 1 is changed. The steering actuator 15 is, for instance, an electric motor. However, the steering actuator 15 may be another type of actuator such as an electric cylinder, a hydraulic motor, or a hydraulic cylinder.

The propulsion device 1 includes an engine controller 16. The engine controller 16 includes a processor such as a CPU and memories such as a RAM and a ROM. The engine controller 16 stores a program and data to control the propulsion device 1. The engine controller 16 controls actions of the engine 3, the shift actuator 14, and the steering actuator 15.

The system includes a steering wheel 17, a remote controller 18, and a joystick 19. As shown in FIG. 1, the steering wheel 17, the remote controller 18, and the joystick 19 are disposed in a cockpit of the watercraft 100.

The steering wheel 17 allows an operator to operate the turning direction of the watercraft 100. The steering wheel 17 includes a sensor 21. The sensor 21 outputs a steering signal indicating the operating direction and the operating amount of the steering wheel 17.

The remote controller 18 includes a throttle lever 22. The throttle lever 22 allows the operator to regulate the magnitude of the thrust generated by the propulsion device 1. The throttle lever 22 allows the operator to switch the direction of the thrust generated by the propulsion device 1 between forward and rearward directions. The throttle lever 22 is operable from a neutral position to a forward direction and a rearward direction. The neutral position is located between the forward direction and the rearward direction. The throttle lever 22 includes a sensor 23. The sensor 23 outputs a throttle signal indicating the operating direction and the operating amount of the throttle lever 22.

The joystick 19 allows the operator to operate the moving direction of the watercraft 100. The joystick 19 allows the operator to operate a bow pivoting action performed by the watercraft 100. The joystick 19 is tiltable at least in the back-and-forth direction. It should be noted that the joystick 19 may be tiltable in four directions including front, rear, right, and left. Alternatively, the joystick 19 may be tiltable in four or more directions or all directions.

The joystick 19 is twistable about a rotational axis Ax1. The joystick 19 includes a sensor 24. The sensor 24 outputs a joystick signal indicating the tilt direction and the tilt amount of the joystick 19. The sensor 24 outputs a joystick signal indicating the twist direction and the twist amount of the joystick 19.

The system includes a watercraft operating controller 25. The watercraft operating controller 25 includes a processor such as a CPU and memories such as a RAM and a ROM. The watercraft operating controller 25 stores a program and data to control the propulsion device 1. The watercraft operating controller 25 is connected to the engine controller 16 through wired or wireless communication. The watercraft operating controller 25 is connected to the steering wheel 17, the remote controller 18, and the joystick 19 through wired or wireless communication. The watercraft operating controller 25 may include a plurality of controllers.

The watercraft operating controller 25 receives the steering signal from the sensor 21. The watercraft operating controller 25 receives the throttle signal from the sensor 23. The watercraft operating controller 25 receives the joystick signal from the sensor 24. The watercraft operating controller 25 outputs command signals to the engine controller 16, the shift actuator 14, and the steering actuator 15 based on the signals from the sensors 21, 23, and 24.

For example, the watercraft operating controller 25 outputs a command signal to the shift actuator 14 in accordance with the operating direction of the throttle lever 22. In response, a shifting action, performed by the propulsion device 1 to shift among forward, neutral, and reverse, is controlled. The watercraft operating controller 25 outputs a command signal to the engine 3 in accordance with the operating amount of the throttle lever 22. In response, the engine rotational speed of the propulsion device 1 is controlled.

The watercraft operating controller 25 outputs a command signal to the steering actuator 15 in accordance with the operating direction and the operating amount of the steering wheel 17. When the steering wheel 17 is operated leftward from the neutral position, the watercraft operating controller 25 controls the steering actuator 15 such that the propulsion device 1 is rotated clockwise. The watercraft 100 thus turns leftward. When the steering wheel 17 is operated rightward from the neutral position, the watercraft operating controller 25 controls the steering actuator 15 such that the propulsion device 1 is rotated counterclockwise. The watercraft 100 thus turns rightward. The watercraft operating controller 25 controls the rudder angle of the propulsion device 1 in accordance with the operating amount of the steering wheel 17.

The watercraft operating controller 25 outputs command signals to the engine 3, the shift actuator 14, and the steering actuator 15 in accordance with the tilt direction and the tilt amount of the joystick 19. The watercraft operating controller 25 controls the engine 3, the shift actuator 14, and the steering actuator 15 such that the watercraft 100 is moved at a velocity corresponding to the tilt amount of the joystick 19 in a direction corresponding to the tilt direction of the joystick 19.

More specifically, the watercraft operating controller 25 controls the shifting action performed by the propulsion device 1 to shift among forward, neutral, and reverse in accordance with the tilt operation of the joystick 19 in the back-and-forth direction. When the joystick 19 is tilted forward, the watercraft operating controller 25 moves the watercraft 100 forward. When the joystick 19 is tilted rearward, the watercraft operating controller 25 moves the watercraft 100 rearward.

The watercraft operating controller 25 controls steering of the propulsion device 1 in accordance with the twist operation of the joystick 19. The watercraft operating controller 25 controls the steering actuator 15 such that the watercraft 100 pivots in a direction corresponding to the twist direction of the joystick 19 (bow pivoting mode).

Figure 4:
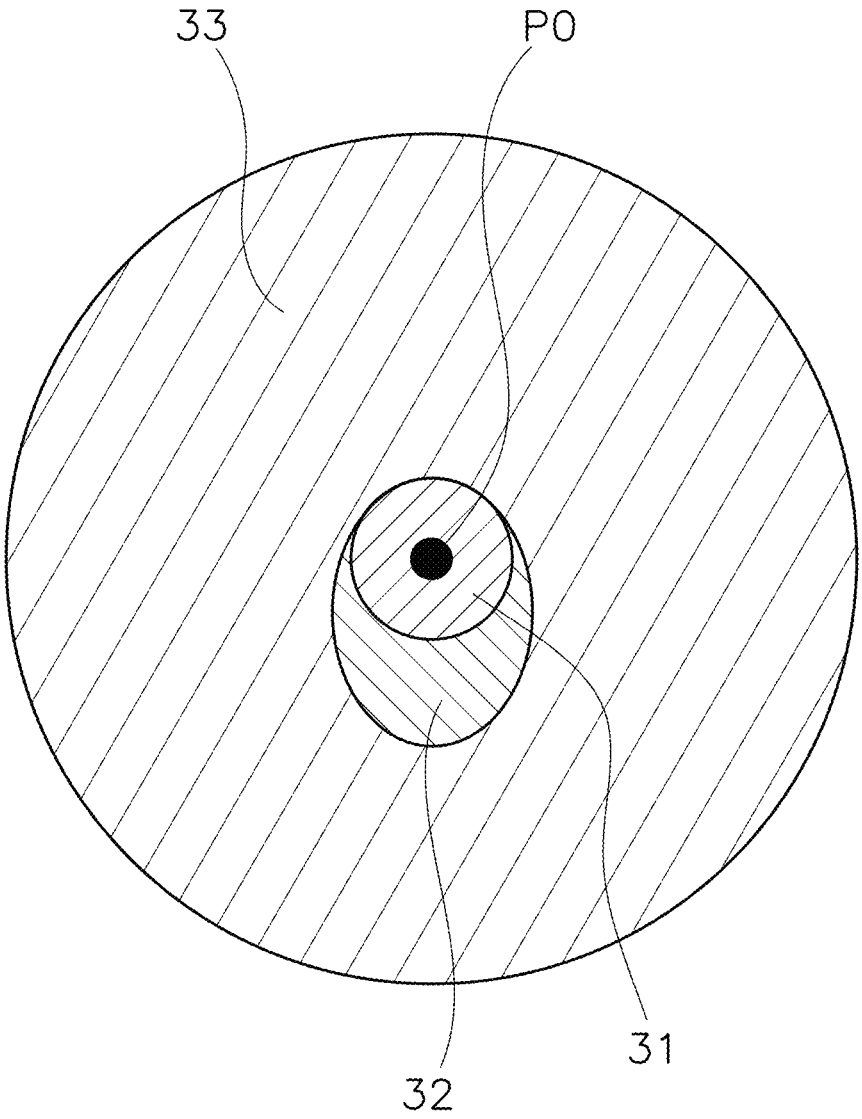
FIG. 4 is a diagram showing an operating range of a joystick.

The bow pivoting mode using the joystick 19 will be hereinafter explained in detail. FIG. 4 is a schematic diagram showing an operating range of the joystick 19. In FIG. 4, "P0" indicates a neutral position. The neutral position P0 indicates a position of the joystick 19 that is not being tilted. In FIG. 4, the joystick 19 is in a central position. The central position indicates a position of the joystick 19 that is not twisted.

As shown in FIG. 4, the joystick 19 is operable to any of the positions located within a range including a first dead zone 31, a second dead zone 32, and a normal operating zone 33. The first dead zone 31 includes the neutral position P0. The second dead zone 32 is located rearward of the first dead zone 31. The normal operating zone 33 is located forward of the first dead zone 31 and rearward of the second dead zone 32.

Figure 5:
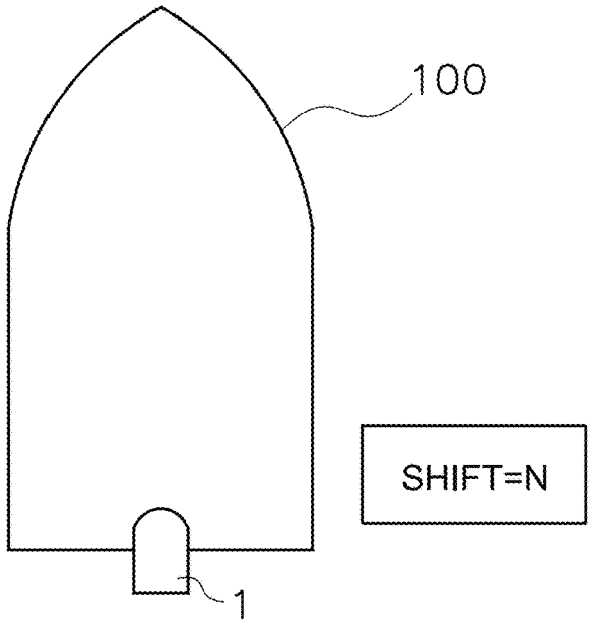
FIG. 5 is a diagram showing a process of a bow pivoting mode according to a first preferred embodiment of the present invention.
Figure 5:
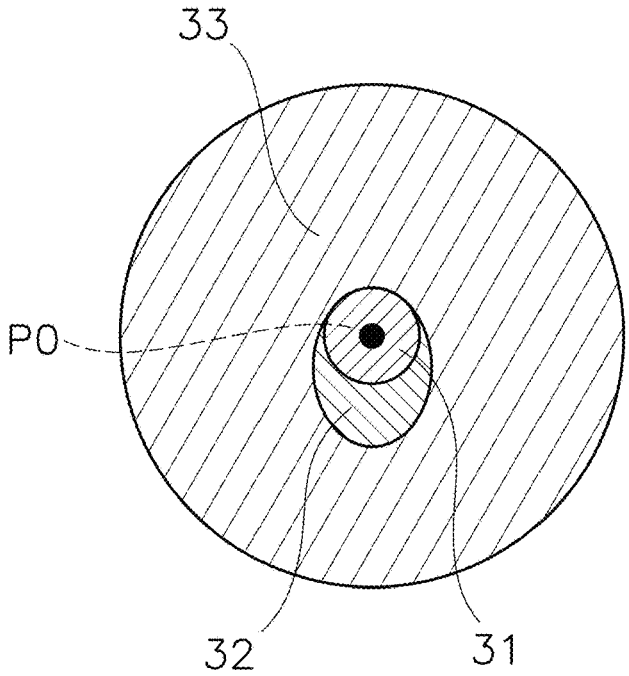

FIGS. 5 to 13 show processes of the bow pivoting mode according to a first preferred embodiment of the present invention. As shown in FIG. 5, when the joystick 19 is positioned within the first dead zone 31, the watercraft operating controller 25 pauses the shifting action and the steering of the propulsion device 1 regardless of the tilt operation and the twist operation of the joystick 19. Therefore, when the joystick 19 is positioned within the first dead zone 31, the propulsion device 1 is shifted to neutral and the steering position of the propulsion device 1 is located at the center.

Figure 6:
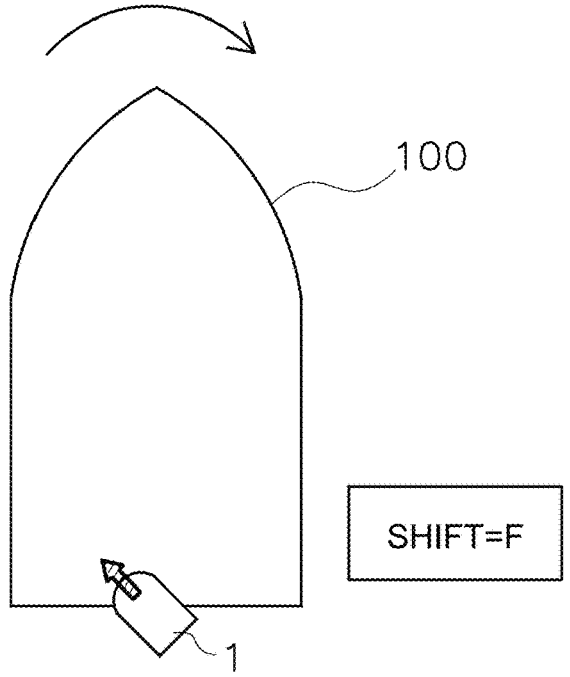
FIG. 6 is a diagram showing a process of the bow pivoting mode according to the first preferred embodiment of the present invention.
Figure 6:
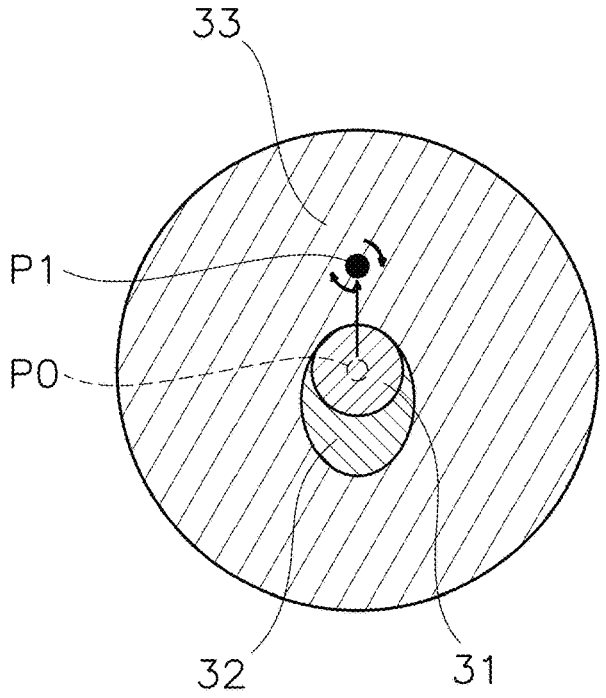

Controlling the twisting of the joystick 19 clockwise will be hereinafter explained. As shown in FIG. 6, when the joystick 19 is twisted clockwise and is operated to a first position P1, the watercraft operating controller 25 shifts the propulsion device 1 forward and steers the propulsion device 1 counterclockwise. The first position P1 is a position that is located forward of (outside of) the first dead zone 31 and is located within the normal operating zone 33. Accordingly, the watercraft 100 turns the bow clockwise while moving forward. It should be noted that the first position P1 is not limited to the position shown in FIG. 6 and may be any other position that is located forward of the first dead zone 31 and located within the normal operating zone 33.

Figure 7:
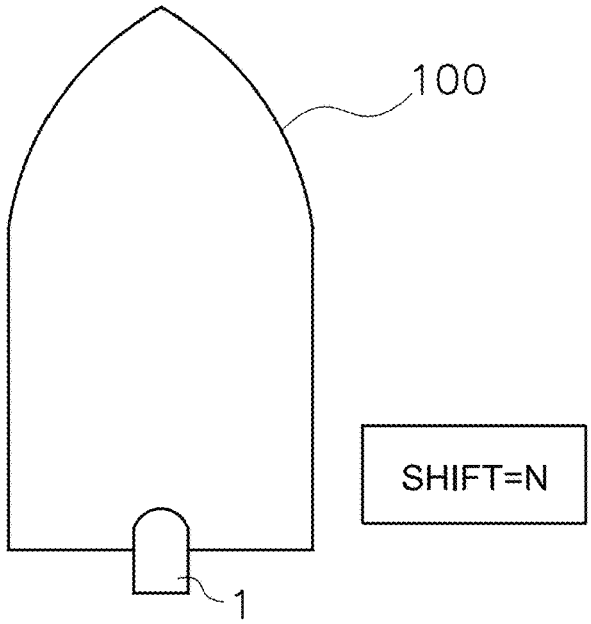
FIG. 7 is a diagram showing a process of the bow pivoting mode according to the first preferred embodiment of the present invention.
Figure 7:
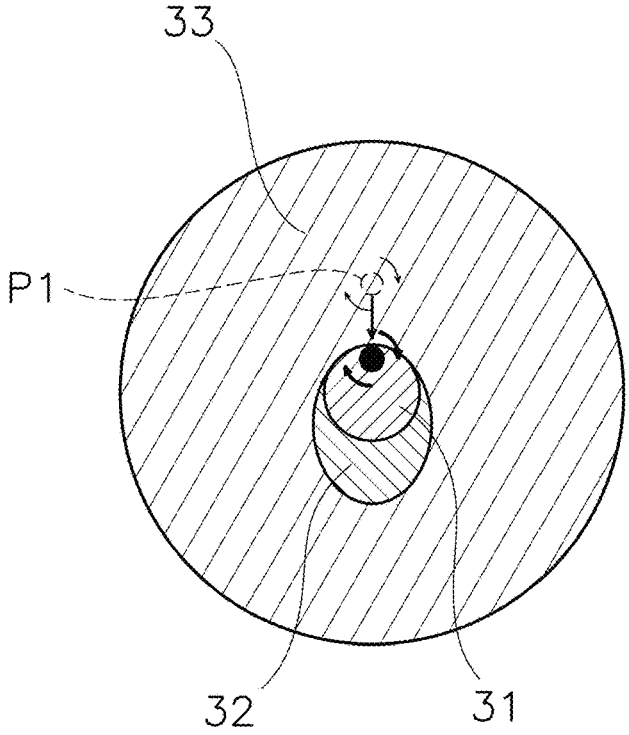

As shown in FIG. 7, when the joystick 19 is operated rearward from the first position P1 to the first dead zone 31 while being twisted clockwise, the watercraft operating controller 25 returns the steering position of the propulsion device 1 to the center and shifts the propulsion device 1 from forward to neutral. In this condition, the watercraft operating controller 25 pauses the shifting action and the steering of the propulsion device 1 regardless of the tilt operation and the twist operation of the joystick 19.

Figure 8:
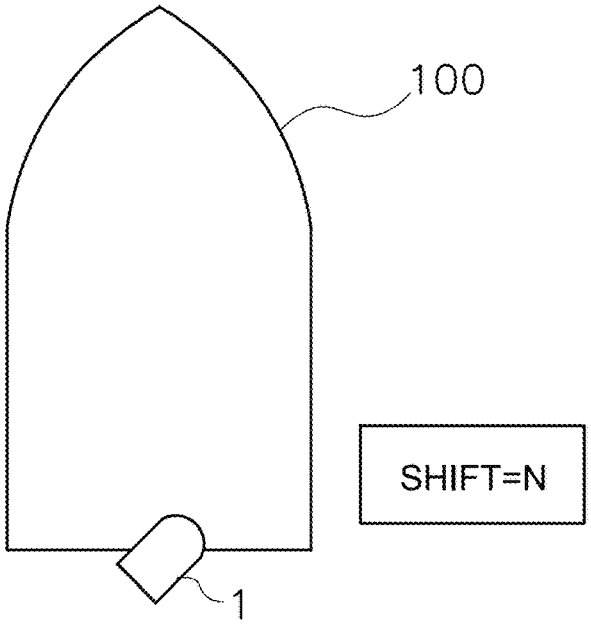
FIG. 8 is a diagram showing a process of the bow pivoting mode according to the first preferred embodiment of the present invention.
Figure 8:
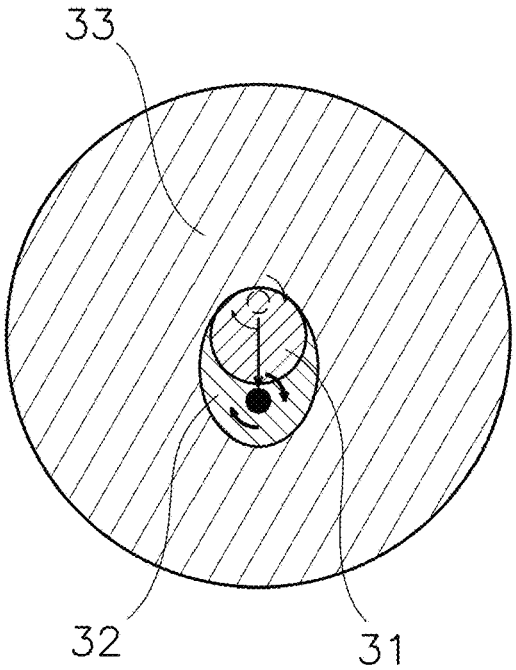

As shown in FIG. 8, when the joystick 19 is operated rearward from the first dead zone 31 to the second dead zone 32 while being twisted clockwise, the watercraft operating controller 25 steers the propulsion device 1 clockwise while maintaining the shift position of the propulsion device 1 in neutral.

Figure 9:
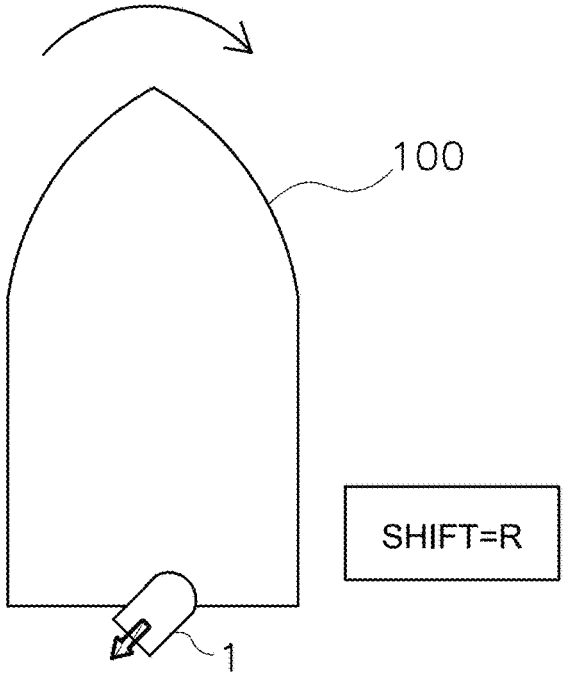
FIG. 9 is a diagram showing a process of the bow pivoting mode according to the first preferred embodiment of the present invention.
Figure 9:
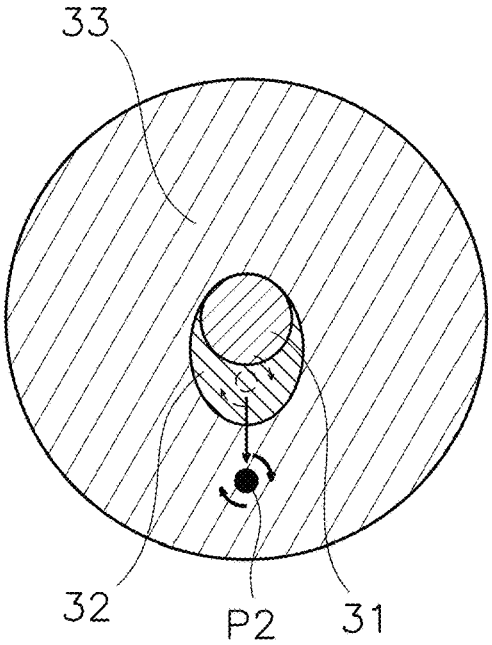

As shown in FIG. 9, when the joystick 19 is operated rearward from the second dead zone 32 to a second position P2 while being twisted clockwise, the watercraft operating controller 25 shifts the propulsion device 1 from neutral to reverse while maintaining the clockwise steering position. The second position P2 is a position that is located rearward of (outside of) the second dead zone 32 and within the normal operating zone 33. Accordingly, the watercraft 100 turns the bow clockwise while moving rearward. It should be noted that the second position P2 is not limited to the position shown in FIG. 9 and may be any other position that is located rearward of the second dead zone 32 and is located within the normal operating zone 33.

Figure 10:
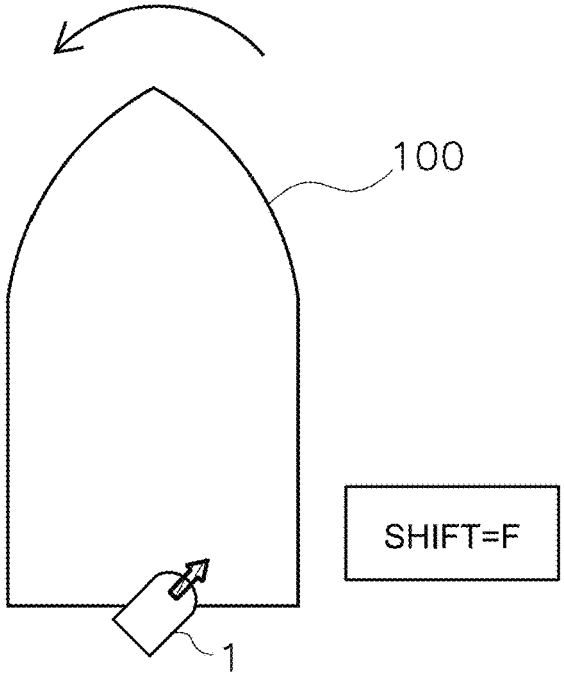
FIG. 10 is a diagram showing a process of the bow pivoting mode according to the first preferred embodiment of the present invention.
Figure 10:
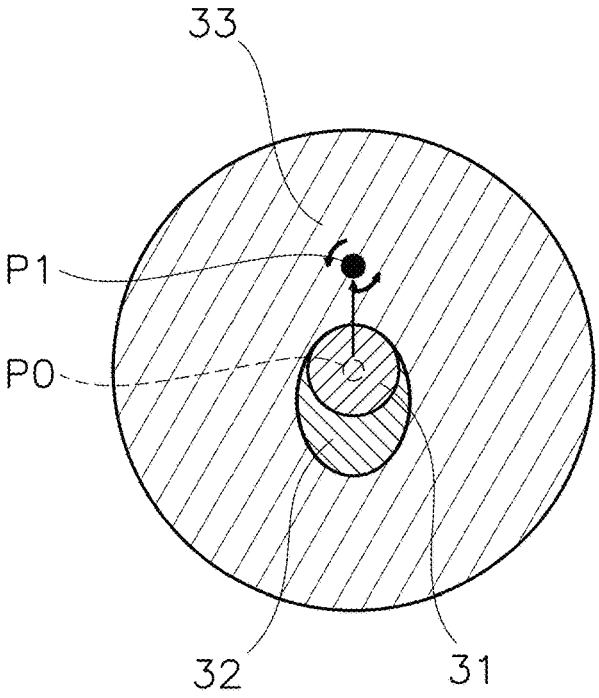

Next, control of twisting the joystick 19 counterclockwise will be explained. As shown in FIG. 10, when the joystick 19 is twisted counterclockwise and is operated to the first position P1, the watercraft operating controller 25 shifts the propulsion device 1 to forward and steers the propulsion device 1 clockwise. Accordingly, the watercraft 100 turns the bow counterclockwise while moving forward.

Figure 11:
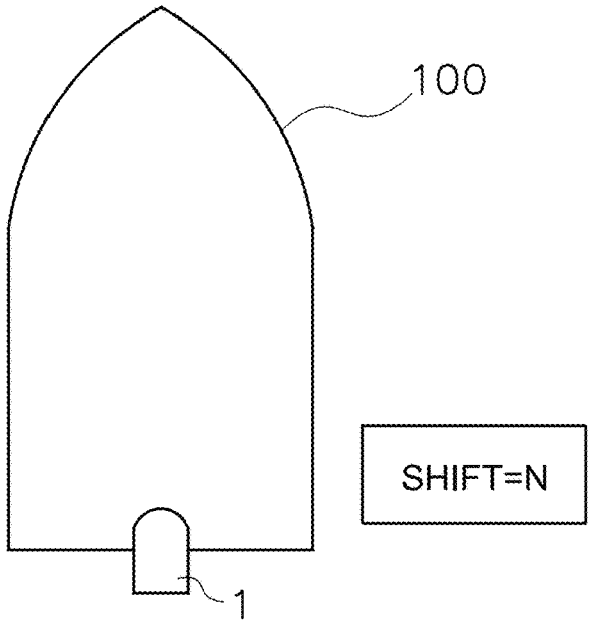
FIG. 11 is a diagram showing a process of the bow pivoting mode according to the first preferred embodiment of the present invention.
Figure 11:
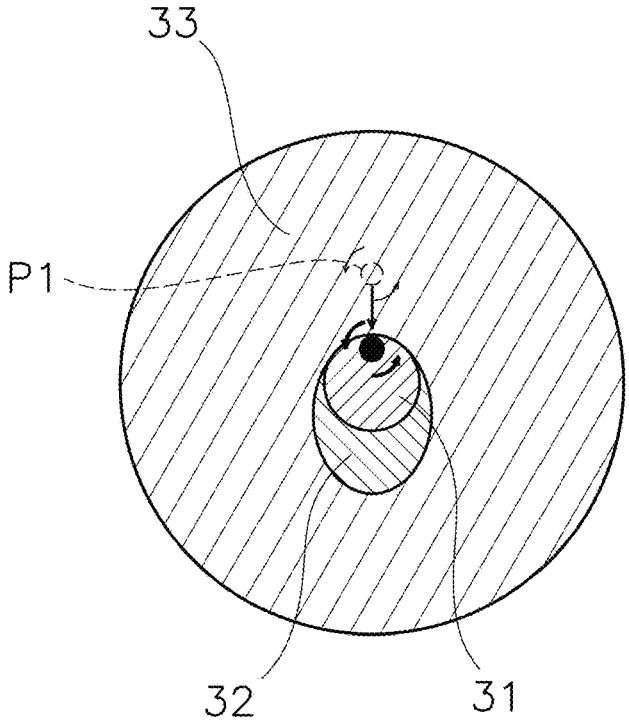

As shown in FIG. 11, when the joystick 19 is operated rearward from the first position P1 to the first dead zone 31 while being twisted counterclockwise, the watercraft operating controller 25 returns the steering position of the propulsion device 1 to the center and shifts the propulsion device 1 from forward to neutral. In this condition, the watercraft operating controller 25 pauses the shifting action and the steering of the propulsion device 1 regardless of the tilt operation and the twist operation of the joystick 19.

Figure 12:
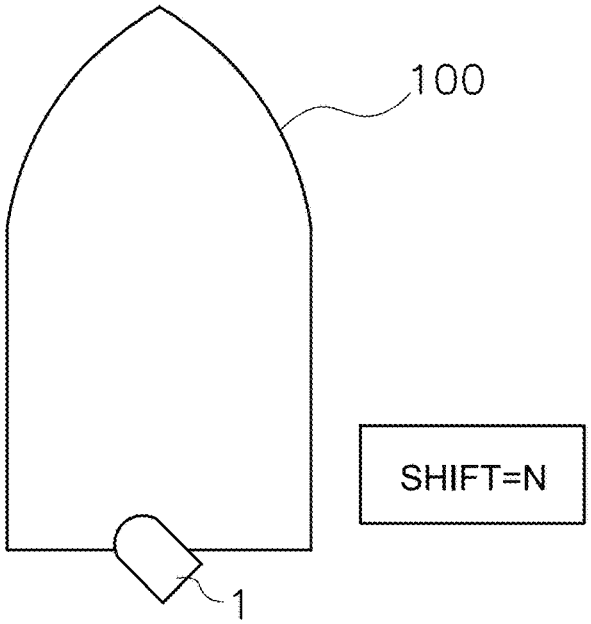
FIG. 12 is a diagram showing a process of the bow pivoting mode according to the first preferred embodiment of the present invention.
Figure 12:
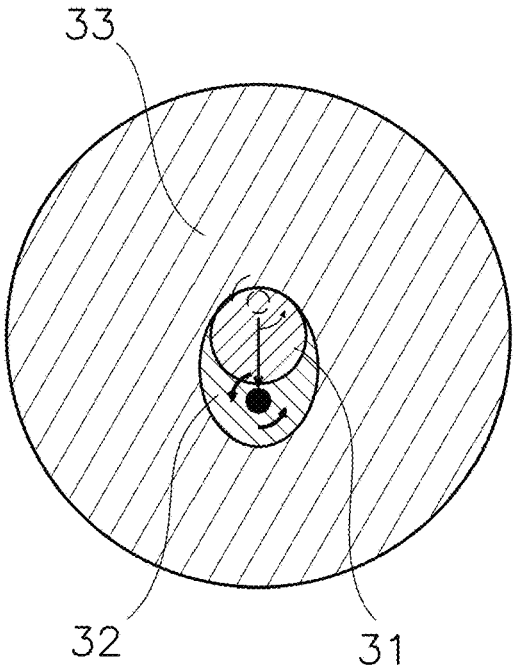

As shown in FIG. 12, when the joystick 19 is operated rearward from the first dead zone 31 to the second dead zone 32 while being twisted counterclockwise, the watercraft operating controller 25 steers the propulsion device 1 counterclockwise while maintaining the shift position of the propulsion device 1 in neutral.

Figure 13:
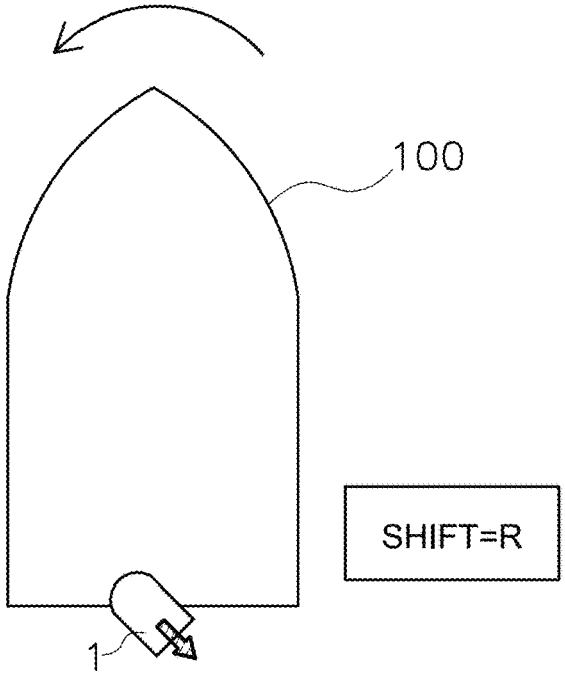
FIG. 13 is a diagram showing a process of the bow pivoting mode according to the first preferred embodiment of the present invention.
Figure 13:
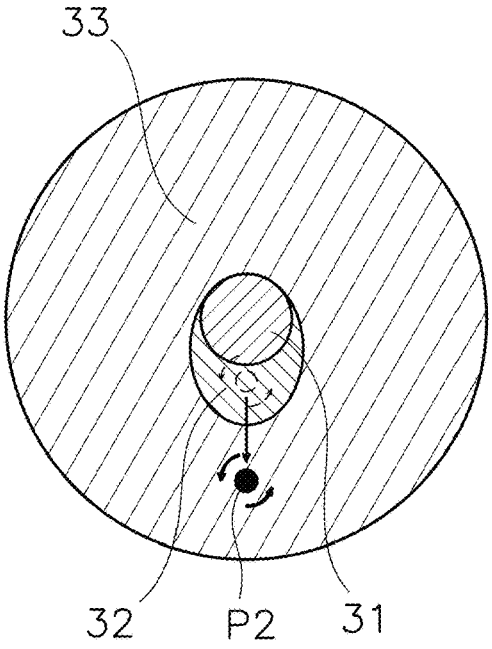

As shown in FIG. 13, when the joystick 19 is operated rearward from the second dead zone 32 to the second position P2 while being twisted counterclockwise, the watercraft operating controller 25 shifts the propulsion device 1 from neutral to reverse while maintaining the counterclockwise steering position of the propulsion device 1. Accordingly, the watercraft 100 turns the bow counterclockwise while moving rearward.

In the system according to the first preferred embodiment explained above, the watercraft 100 is enabled to turn the bow in accordance with the operation of the joystick 19. When the joystick 19 is tilted while being twisted, the watercraft 100 is enabled to turn the bow and simultaneously switch the movement thereof between forward movement and rearward movement.

Figure 14:
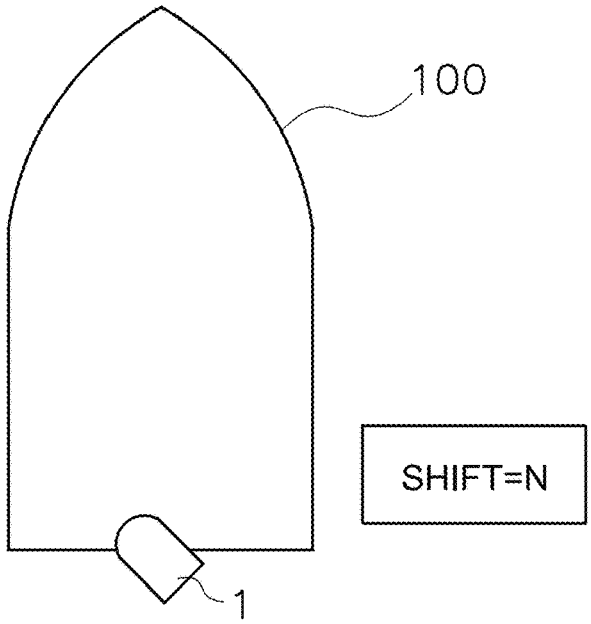
FIG. 14 is a diagram showing a process of a bow pivoting mode according to a second preferred embodiment of the present invention.
Figure 14:
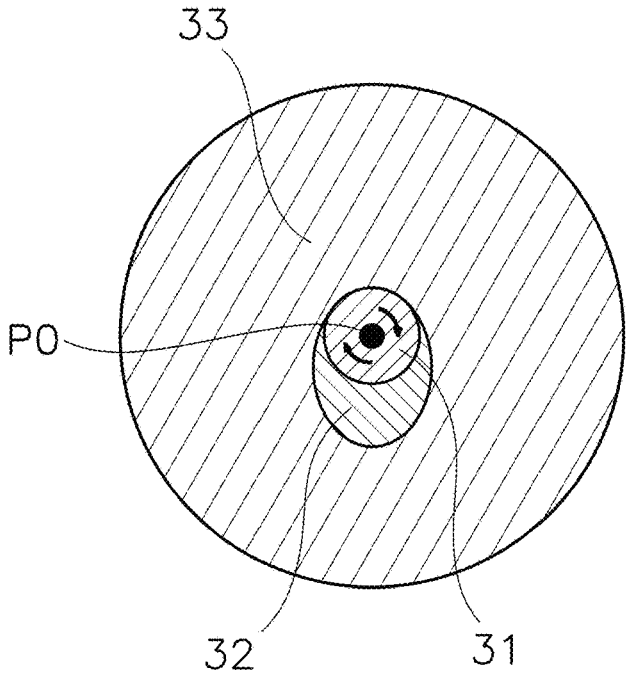

Next, a bow pivoting mode according to a second preferred embodiment of the present invention will be explained. FIGS. 14 to 18 show processes of the bow pivoting mode according to the second preferred embodiment. As shown in FIG. 14, when the joystick 19 is twisted clockwise while being positioned within the first dead zone 31, the watercraft operating controller 25 steers the propulsion device 1 counterclockwise while maintaining the shift of the propulsion device 1 in neutral regardless of the tilt operation of the joystick 19.

Figure 15:
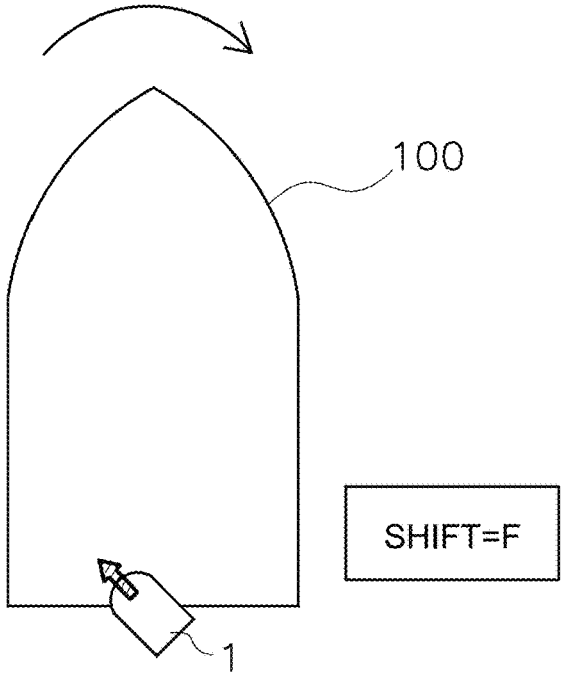
FIG. 15 is a diagram showing a process of the bow pivoting mode according to the second preferred embodiment of the present invention.
Figure 15:
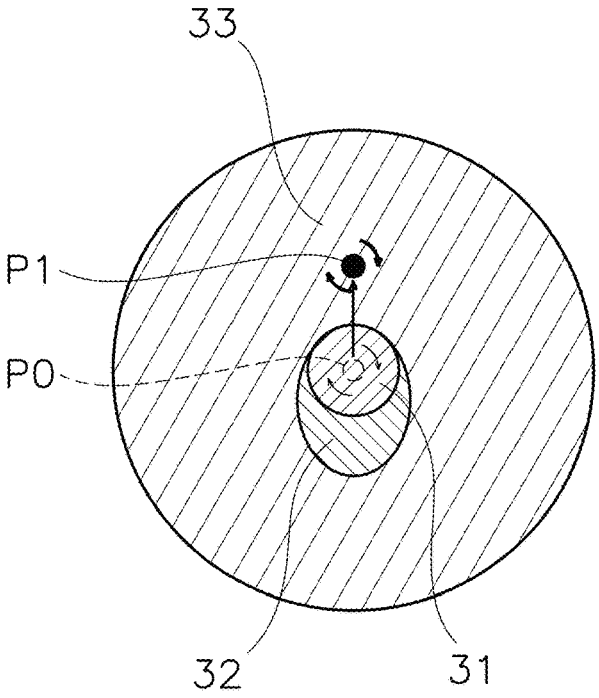

As shown in FIG. 15, when the joystick 19 is operated forward from the first dead zone 31 to the first position P1 while being twisted clockwise, the watercraft operating controller 25 shifts the propulsion device 1 to forward while maintaining the counterclockwise steering position of the propulsion device 1. Accordingly, the watercraft 100 turns the bow clockwise while moving forward.

Figure 16:
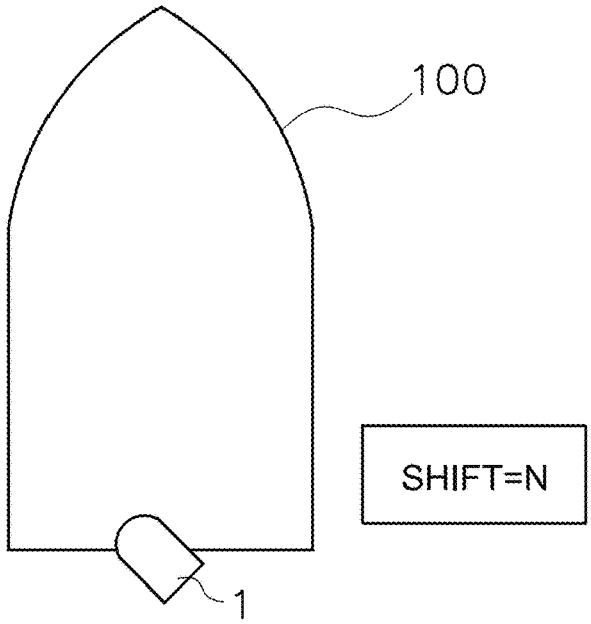
FIG. 16 is a diagram showing a process of the bow pivoting mode according to the second preferred embodiment of the present invention.
Figure 16:
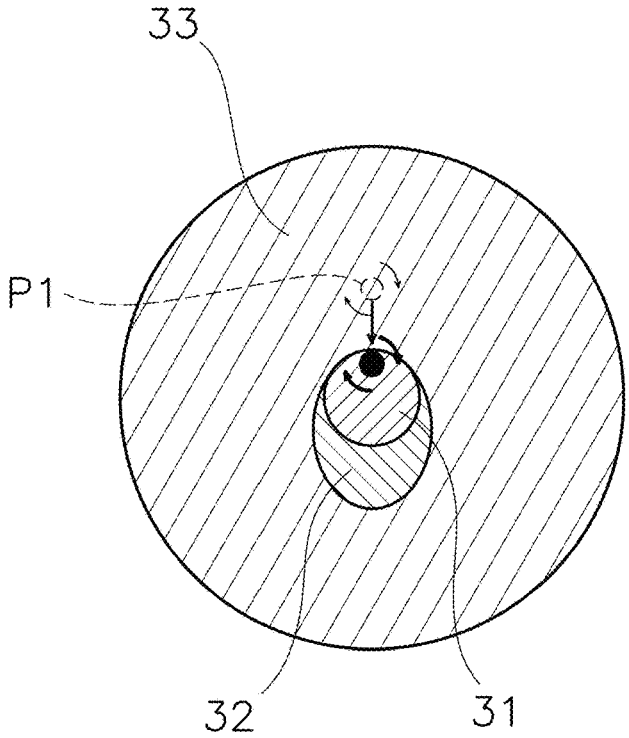

As shown in FIG. 16, when the joystick 19 is operated rearward from the first position P1 to the first dead zone 31 while being twisted clockwise, the watercraft operating controller 25 shifts the propulsion device 1 from forward to neutral while maintaining the counterclockwise steering position of the propulsion device 1.

Figure 17:
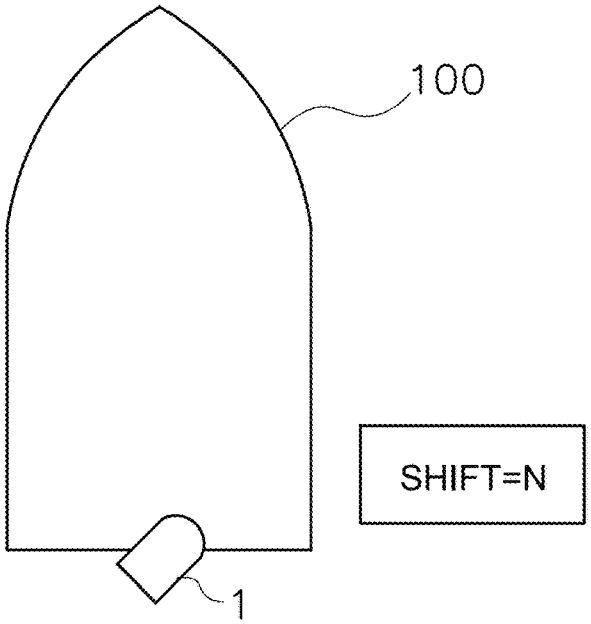
FIG. 17 is a diagram showing a process of the bow pivoting mode according to the second preferred embodiment of the present invention.
Figure 17:
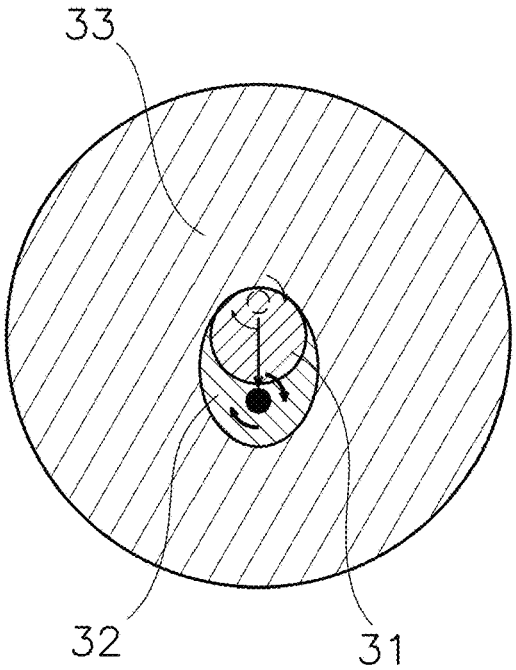

As shown in FIG. 17, when the joystick 19 is operated rearward from the first dead zone 31 to the second dead zone 32 while being twisted clockwise, the watercraft operating controller 25 steers the propulsion device 1 clockwise while maintaining the shift position of the propulsion device 1 in neutral.

Figure 18:
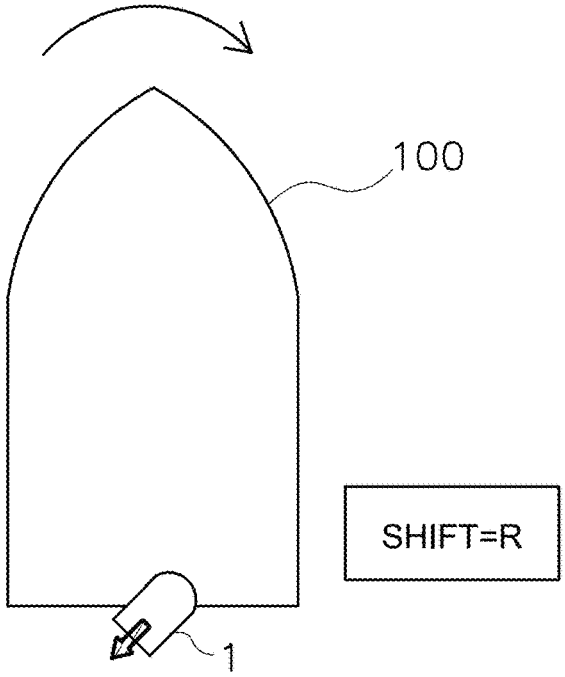
FIG. 18 is a diagram showing a process of the bow pivoting mode according to the second preferred embodiment of the present invention.
Figure 18:
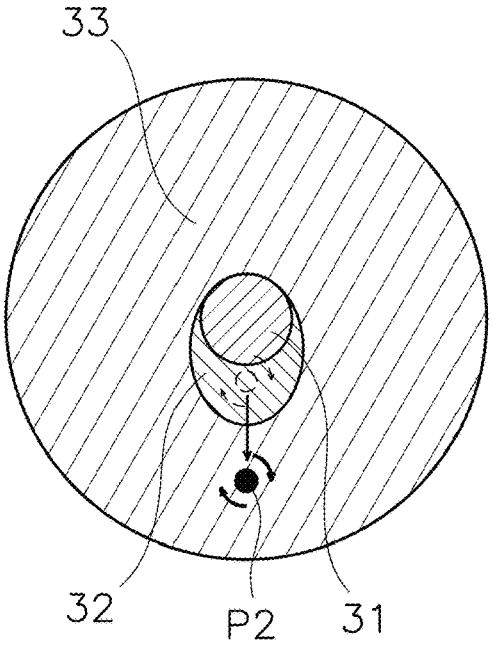

As shown in FIG. 18, when the joystick 19 is operated rearward from the second dead zone 32 to the second position P2 while being twisted clockwise, the watercraft operating controller 25 shifts the propulsion device 1 from neutral to reverse while maintaining the clockwise steering position of the propulsion device 1. Accordingly, the watercraft 100 turns the bow clockwise while moving rearward. The processes performed when the joystick 19 is twisted clockwise have been explained above. When the joystick 19 is twisted counterclockwise, the watercraft operating controller 25 executes similar processes to the above except that the propulsion device 1 is steered in a direction opposite to that described above.

Preferred embodiments of the present invention have been explained above. However, the present invention is not limited to the above-described preferred embodiments, and a variety of changes can be made without departing from the gist of the present invention. For example, the number of propulsion devices is not limited to one, and alternatively, may be greater than one. Parts or portions of the above-described components of the propulsion device 1 may be changed or omitted. The propulsion device 1 is not limited to the outboard motor, and alternatively, may be another type of device such as a water jet propulsion device. The above-described processes may be changed or omitted in part. The shape or location of the first dead zone 31 is not limited to that in the above-described preferred embodiments and may be changed. The shape or location of the second dead zone 32 is not limited to that in the above-described preferred embodiments and may be changed.

According to preferred embodiments of the present invention, changes in the steering of a propulsion device are easily made using a joystick.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for controlling a propulsion device, the system comprising:

a joystick tiltable from a neutral position in a back-and-forth direction and operable by a twist operation; and a controller in communication with the joystick and configured or programmed to:

control a shifting action of the propulsion device among forward, neutral, and reverse in accordance with a tilt operation of the joystick in the back-and-forth direction;

control steering of the propulsion device in accordance with the twist operation of the joystick;

pause the shifting action and the steering of the propulsion device regardless of the tilt operation and the twist operation of the joystick when the joystick is positioned within a first dead zone including the neutral position; and pause the shifting action of the propulsion device regardless of the tilt operation of the joystick and control the steering of the propulsion device in accordance with the twist operation of the joystick when the joystick is positioned within a second dead zone located rearward of the first dead zone.

2. The system according to claim 1, wherein the controller is configured or programmed to:

shift the propulsion device to forward and steer the propulsion device counterclockwise when the joystick is twisted clockwise and is positioned in a first position located forward of the first dead zone; and shift the propulsion device from forward to neutral when the joystick is operated from the first position to the first dead zone by the tilt operation while being twisted clockwise.

3. The system according to claim 2, wherein the controller is configured or programmed to:

steer the propulsion device clockwise while maintaining the propulsion device in neutral when the joystick is operated from the first dead zone to the second dead zone by the tilt operation while being twisted clockwise.

4. The system according to claim 3, wherein the controller is configured or programmed to:

shift the propulsion device from neutral to reverse while maintaining a clockwise steering position of the propulsion device when the joystick is operated from the second dead zone to a second position located rearward of the second dead zone by the tilt operation while being twisted clockwise.

5. The system according to claim 1, wherein the controller is configured or programmed to:

shift the propulsion device to forward and steer the propulsion device clockwise when the joystick is twisted counterclockwise and is positioned in a first position located forward of the first dead zone; and shift the propulsion device from forward to neutral when the joystick is operated from the first position to the first dead zone by the tilt operation while being twisted counterclockwise.

6. The system according to claim 5, wherein the controller is configured or programmed to:

steer the propulsion device counterclockwise while maintaining the propulsion device in neutral when the joystick is operated from the first dead zone to the second dead zone by the tilt operation while being twisted counterclockwise.

7. The system according to claim 6, wherein the controller is configured or programmed to:

shift the propulsion device from neutral to reverse while maintaining a counterclockwise steering position of the propulsion device when the joystick is operated from the second dead zone to a second position located rearward of the second dead zone while being twisted counterclockwise.

8. A method of controlling a propulsion device, the method comprising:

receiving a signal from a joystick that is tiltable from a neutral position in a back-and-forth direction and operable by a twist operation;

controlling a shifting action of the propulsion device among forward, neutral, and reverse in accordance with a tilt operation of the joystick in the back-and-forth direction;

controlling steering of the propulsion device in accordance with the twist operation of the joystick;

pausing the shifting action and the steering of the propulsion device regardless of the tilt operation and the twist operation of the joystick when the joystick is positioned within a first dead zone including the neutral position; and pausing the shifting action of the propulsion device regardless of the tilt operation of the joystick and controlling the steering of the propulsion device in accordance with the twist operation of the joystick when the joystick is positioned within a second dead zone located rearward of the first dead zone.

9. The method according to claim 8, further comprising:

shifting the propulsion device to forward and steering the propulsion device counterclockwise when the joystick is twisted clockwise and is positioned in a first position located forward of the first dead zone; and shifting the propulsion device from forward to neutral when the joystick is operated from the first position to the first dead zone by the tilt operation while being twisted clockwise.

10. The method according to claim 9, further comprising:

steering the propulsion device clockwise while maintaining the propulsion device in neutral when the joystick is operated from the first dead zone to the second dead zone while being twisted clockwise.

11. The method according to claim 10, further comprising:

shifting the propulsion device from neutral to reverse while maintaining a clockwise steering position of the propulsion device when the joystick is operated from the second dead zone to a second position located rearward of the second dead zone by the tilt operation while being twisted clockwise.

12. The method according to claim 8, further comprising:

shifting the propulsion device to forward and steering the propulsion device clockwise when the joystick is twisted counterclockwise and is positioned in a first position located forward of the first dead zone; and shifting the propulsion device from forward to neutral when the joystick is operated from the first position to the first dead zone by the tilt operation while being twisted counterclockwise.

13. The method according to claim 12, further comprising:

steering the propulsion device counterclockwise while maintaining the propulsion device in neutral when the joystick is operated from the first dead zone to the second dead zone by the tilt operation while being twisted counterclockwise.

14. The method according to claim 13, further comprising:

shifting the propulsion device from neutral to reverse while maintaining a counterclockwise steering position of the propulsion device when the joystick is operated from the second dead zone to a second position located rearward of the second dead zone by the tilt operation while being twisted counterclockwise.

15. A system for controlling a propulsion device, the system comprising:

a joystick tiltable from a neutral position in a back-and-forth direction and operable by a twist operation; and a controller in communication with the joystick and being configured or programmed to:

control a shifting action of the propulsion device among forward, neutral, and reverse in accordance with a tilt operation of the joystick operated in the back-and-forth direction;

control steering of the propulsion device in accordance with the twist operation of the joystick;

pause the shifting action of the propulsion device regardless of the tilt operation of the joystick and steer the propulsion device in a first direction in accordance with the twist operation of the joystick operated in a predetermined direction when the joystick is positioned within a first dead zone including the neutral position; and pause the shifting action of the propulsion device regardless of the tilt operation of the joystick and steer the propulsion device in a second direction opposite to the first direction in accordance with the twist operation of the joystick operated in the predetermined direction when the joystick is positioned within a second dead zone located rearward of the first dead zone.

16. A method comprising:

receiving a signal from a joystick that is tiltable from a neutral position in a back-and-forth direction and operable by a twist operation;

controlling a shifting action of a propulsion device among forward, neutral, and reverse in accordance with a tilt operation of the joystick operated in the back-and-forth direction;

controlling steering of the propulsion device in accordance with the twist operation of the joystick;

pausing the shifting action of the propulsion device regardless of the tilt operation of the joystick and steering the propulsion device in a first direction in accordance with the twist operation of the joystick operated in a predetermined direction when the joystick is positioned within a first dead zone including the neutral position; and pausing the shifting action of the propulsion device regardless of the tilt operation of the joystick and steering the propulsion device in a second direction opposite to the first direction in accordance with the twist operation of the joystick operated in the predetermined direction when the joystick is positioned within a second dead zone located rearward of the first dead zone.

* * * * *